United States Patent [19]

Du Vall

[11] Patent Number: 4,601,130

[45] Date of Patent: Jul. 22, 1986

[54] RETAINER FOR ATTACHING A FLOWER CONTAINER LID

[75] Inventor: Gregory Du Vall, Santa Monica, Calif.

[73] Assignee: Teleflora, Inc., Los Angeles, Calif.

[21] Appl. No.: 628,218

[22] Filed: Jul. 5, 1984

[51] Int. Cl.[4] ..... A01G 5/00

[52] U.S. Cl. ..... 47/41.12

[58] Field of Search ..... 47/41, 41.55, 41.1, 47/41.11, 41.12; 200/85 CH

[56] References Cited

U.S. PATENT DOCUMENTS

| | | | |
|---|---|---|---|
| 834,746 | 9/1906 | Moulie | 47/41.11 |
| 1,491,926 | 4/1924 | Rosenwald | 47/41.11 |
| 4,521,990 | 6/1985 | Murray | 47/41.12 |

*Primary Examiner*—Robert A. Hafer
*Assistant Examiner*—Bradley M. Lewis
*Attorney, Agent, or Firm*—Pretty, Schroeder, Brueggemann & Clark

[57] ABSTRACT

A flexible wire retainer for use in attaching a lid to an accompanying flower container while the container is being used to hold and display a flower arrangement. The wire retainer is formed into a special shape that includes a U-shaped portion that can be conveniently placed beneath and retained by a recess on the lid's underside. The retainer further includes a pair of integral shafts that can project through the container opening to engage and be supported by a conventional foam block located within the container.

10 Claims, 9 Drawing Figures

RETAINER FOR ATTACHING A FLOWER CONTAINER LID

BACKGROUND OF THE INVENTION

This invention relates generally to flower containers, and more particularly, to disposable, resilient retainers for use in removably attaching a mating lid to the flower container.

It recently has become popular to sell flower arrangements along with items that can be used by the purchaser after the flowers are no longer fresh and have been discarded. For example, arrangements are now frequently sold in useful containers such as cookie jars, coffee pots and the like, which have mating, detachable lids. Florists have encountered difficulty in selling arrangements in such two-piece containers, however, because of the lack of a convenient device for securing the lid to the container at the time of the sale.

Several different techniques and devices have been used in the past to secure the lids to the containers at the time of the sale. One such technique has been to affix the lid directly to the container's side using adhesive tape. Although this technique is generally effective at securing the lid, the high visibility of the tape and the inappropriate position of the lid on the side of the container create an overall appearance that detracts from the beauty of the accompanying flower arrangement.

Another technique for securing a lid to a flower container is described in U.S. Pat. No. 4,521,990, issued in the name of John F. Murray and entitled "RETAINER FOR ATTACHING FLORAL CONTAINER LID." The retainer depicted in that application includes a crossbar releasably enagable with the lid, and a shaft fixed to the crossbar and extending generally perpendicular from it. The far end of the shaft is received within and supported by a body of stalk-supporting material located within the container, and the crossbar is retained by a pair of spaced, opposed recesses formed on the lid's underside.

Although the retainer shown in the referenced patent application is generally effective in securing a lid to its corresponding container, it has not proven to be entirely satisfactory. In many lid configurations, the crossbar must have a precise relative size in order to be securely retained by the lid recesses. This can be a significant problem when the container and mating lid are not themselves formed to a precise tolerance.

It should therefore be appreciated that there is a need for an improved retainer that can be conveniently used to attach a lid to a container simultaneously being used to hold a flower arrangement, even though the lid and container might have very imprecise dimensions. The represent invention fulfills this need.

SUMMARY OF THE INVENTION

The present invention is embodied in an improved retainer for use in selectively attaching a lid to a container holding a flower arrangement, in such a way that the lid attractively complements the arrangement. The retainer is inexpensive to manufacture and convenient to use, and can be used with a range of differently-sized lids.

More particularly, the retainer of the invention is suitable for use with a flower container having an opening that can be selectively covered by the lid or used to receive the stalks of a flower arrangement. The lid includes two spaced, opposed recesses on its underside, for engagement by the retainer of the invention. A body of stalk-supporting material is removably positioned within the container, for receiving and supporting the ends of the flower stalks. In accordance with invention, the retainer includes a generally U-shaped portion with two legs that can be selectively flexed to engage and be retained by the lid recesses. The retainer further includes an integral extension portion that projects outwardly from the end of one leg and that is sufficiently long to extend through the container opening to engage and be supported by the body of stalk-supporting material. This retainer configuration lends itself to convenient use with a wide variety of lid shapes.

In other aspects of the invention, the retainer can further include a second integral extension projecting outwardly from the end of the other leg. Like the first extension, the second extension should be sufficiently long to extend through the container opening to engage and be supported by the body of stalk-supporting material. The retainer is preferably comprised of a single piece of wire formed into the prescribed shape. In this case, the two ends of the wire form the remote ends of the two extensions.

In one form of the invention, the two legs of the retainer's U-shaped portions define a plane, and the retainer's extension portion is substantially straight and perpendicular to this plane. In addition, the lid recesses can be defined by either an inwardly-projecting lip or an outwardly-projecting lip, and the retainer's U-shaped portion can have a shape that generally conforms with that of the lip.

Other aspects and advantages of the present invention will become apparent from the following description of the preferred embodiments, taken in conjunction with the accompanying drawings, which illustrate, by way of example, the principles of the invention.

DESCRIPTION OF THE PREFERRED EMBODIMENTS

With reference now to the drawings, and particularly to FIGS. 1–5, there is shown a first embodiment of a special apparatus for use in attaching a lid 11 to an associated flower-container 13 in such a way that a group of flowers 15 can be attractively arranged in the container. Flower arrangements are frequently sold in containers that have continued usefulness after the flowers are no longer fresh and have been discarded. These containers frequently have mating lids that ideally are attached to the containers in some way while being used to display the flower arrangements. The apparatus of the invention is completely effective in retaining the lid in its selected position, and is both convenient to use and inexpensive to manufacture.

Figure 1:
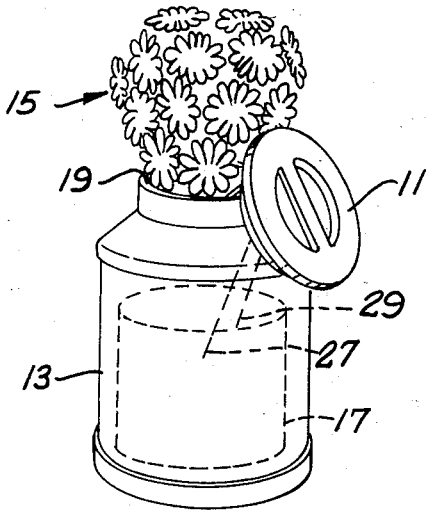
FIG. 1 is a perspective view of a container holding a flower arrangement, in combination with a lid that is mounted on the container using the apparatus of the invention.
Figure 2:
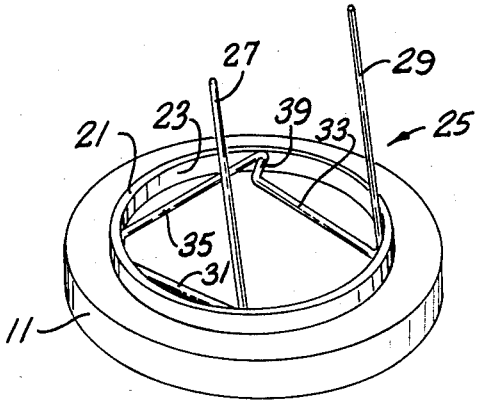
FIG. 2 is a perspective view of the underside of the lid of FIG. 1, showing a disposable wire retainer used to attach the lid in the position shown in FIG. 1.
Figure 3:
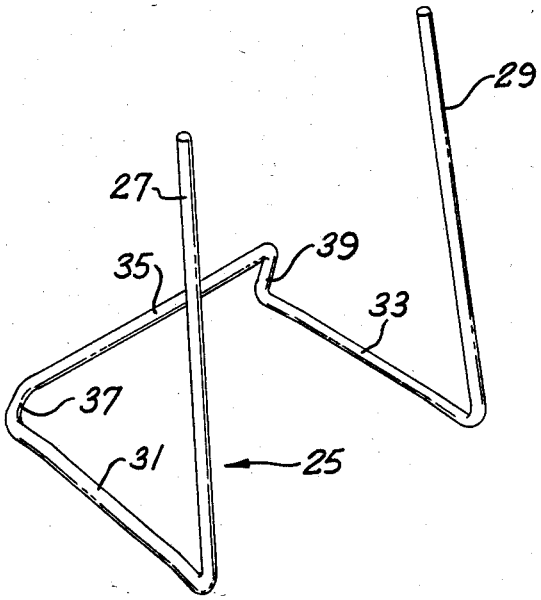
FIG. 3 is a left-front perspective view of the wire retainer of FIG. 2, shown in its unflexed state.

As shown in FIG. 1, the flower arrangement 15 is supported in the container 13 using a block of florist's foam, depicted by the phantom lines 17. The block is typically formed of rigid, foamed polyurethane, and the stalks of the flowers project into the block through an opening 19 in the container's top. The lid 11 includes an annular, undercut rim 21 (FIG. 2) on its underside, which defines an annular recess 23. The rim is sized to fit within the container opening, when the arrangement is removed, to seal the container's interior. When the arrangement is in place, on the other hand, the lid can be attached to the container in the prescribed position, using a special retainer 25.

In accordance with the invention, the lid retainer 25 is comprised of a single piece of wire formed into a special shape that includes a U-shaped portion and a pair of projections or shafts 27 and 29. The U-shaped portion fits snugly into the recess 23 formed on the underside of the lid 11, and the two shafts can be used to project into the foam block 17, to hold the retainer and lid in the position depicted in FIG. 1. After the flowers 15 are no longer fresh and have been discarded, the retainer can be detached from the lid recess and likewise discarded. Since the retainer is formed from a single piece of wire, it is extremely inexpensive to manufacture, yet easy to use and completely effective in retaining the lid in an unobtrusive, secure position.

Figure 4:
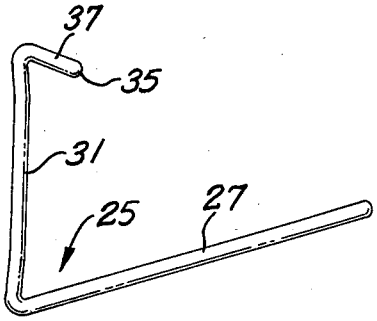
FIG. 4 is a left side elevational view of the wire retainer of FIG. 3.

More particularly, and with reference to FIGS. 2–5 the U-shaped portion of the wire retainer 25 includes a first leg 31 and a second leg 33 connected together at one end by a base 35. The first and second shafts 27 and 29 are integral with and project away from the ends of the respective first and second legs, opposite the base. The two legs are coplanar with each other, and the base is upset from the plane by wire segments 37 and 39, which form a slight acute angle with the plane, as best shown in FIG. 4. In addition, the shafts project outwardly from the plane at a comparable slight acute angle. The base and shafts therefore snugly engage the inwardly facing wall of the rim 21 on the underside of the lid 11.

Figure 5:
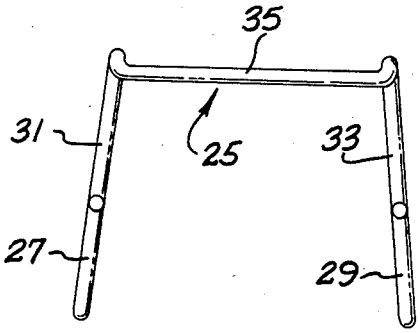
FIG. 5 is a top plan view of the wire retainer of FIG. 3.

In their unflexed state, the retainer legs 31 and 33 diverge slightly with respect to each other, as shown best in FIG. 5. The legs can be selectively flexed toward each other, to permit their placement into the recess 23 formed on the lid's underside. The spring force of the legs thereafter holds the retainer 11 snugly in the position depicted in FIG. 2. By virtue of the retainer's spring action, one retainer size can be used with a large variety of lid sizes. This is an important benefit when used in combination with lids made of a fired ceramic material, which commonly can exhibit large variations in ultimate size.

The two shafts 27 and 29 are desirably long enough to extend through the container opening 19 to engage and be retained by the foam block 17. Actually, depending on the particular configuration of the container 13 and lid 11, and particularly the angle between the retainer's U-shaped portion and shafts, the retainer can function as a hook on the container opening. The lid can thereby be attached to the container without the retainer's engaging the foam block.

Figure 6:
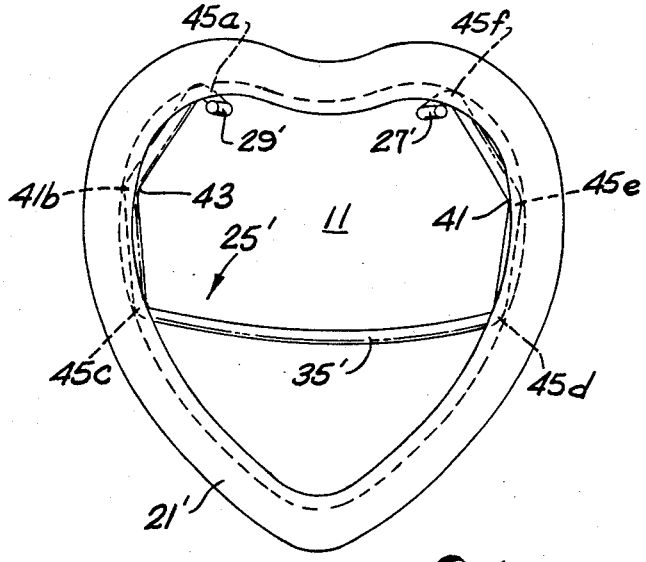
FIG. 6 is a plan view of the underside of a heart-shaped container lid, shown with a second embodiment of a disposable wire retainer.
Figure 7:
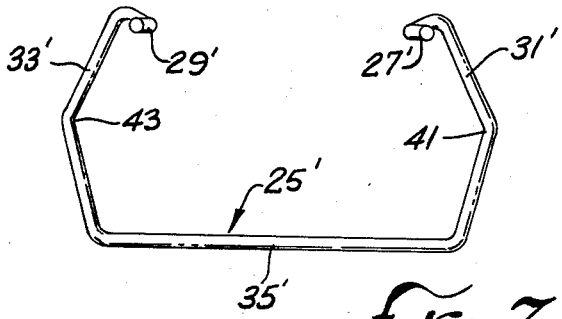
FIG. 7 is a plan view of the wire retainer of FIG. 6, shown in its unflexed state.

FIGS. 6 and 7 depict an alternative configuration for a wire retainer 25' embodying the present invention. In this embodiment, the two legs 31' and 33' of the retainer's U-shaped portion include slight bends 41 and 43 in their mid-portions. These bends cause the legs to have a shape generally conforming with that of the rim 21' on the underside of the lid 11'. In this case, the lid and rim are heart-shaped and the U-shaped portion is retained in the recess at six distinct locations, designated 45*a–f*.

Figure 8:
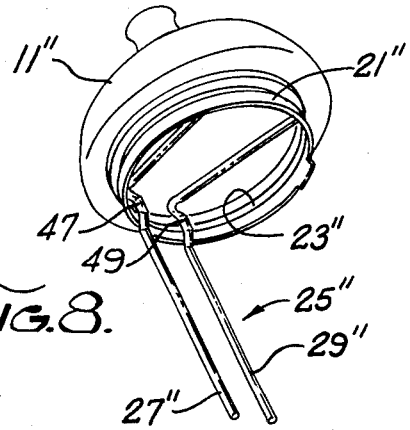
FIG. 8 is a perspective view of a third embodiment of a container lid and disposable wire retainer.

FIG. 8 depicts another configuration for a wire retainer 25'' embodying the present invention. The retainer is similar to that of FIGS. 1–5, but includes slight lateral bends 47 and 49 in its respective first and second shafts 27'' and 29''. These bends permit the shafts to fit snugly within the rim 21'' on the underside of the lid 11''. In addition, the base (not shown) of the retainer's U-shaped portion is coplanar with the two legs 31'' and 33'', and it projects completely into the recess 23'' defined by the rim.

Figure 9:
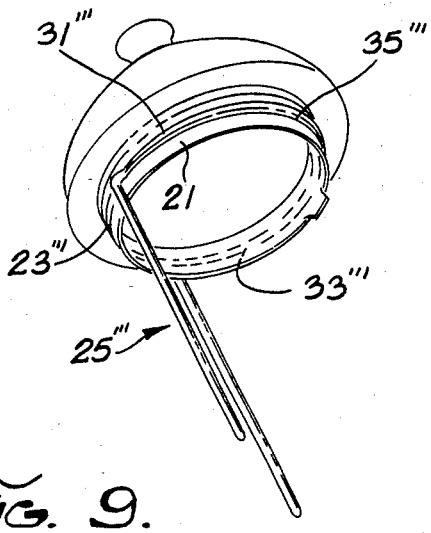
FIG. 9 is a perspective view of a fourth embodiment of a container lid and disposable wire retainer.

FIG. 9 depicts still another configuration for a wire retainer 25''' embodying the present invention. In this embodiment, the retainer's two legs 31''' and 33''' and base 35''' blend smoothly together to form a circular shape. In addition, the lid recess 23''' is defined by a circular lip 21''' that extends outwardly, and the retainer legs flex outwardly to permit their snug placement in the recess.

It should be appreciated from the foregoing description that the present invention provides an improved retainer for use in attaching a lid to a flower container in such a fashion that a flower arrangement can simultaneously be held in the container. The retainer is formed from a single piece of wire bent into a prescribed shape that can be conveniently positioned and snugly held in a recess on the lid's underside. When the flowers are no longer fresh and have been discarded, the retainer can likewise be removed and discarded, permitting the lid to be placed on the container's mating opening.

Although the invention has been described in detail with reference to the presently preferred embodiments, it will be appreciated by those of ordinary skill in the art that various modifications can be made without departing from the invention. Accordingly, the invention is limited only by the following claims.

I claim:

1. In combination:

a container for holding flowers with their stalks projecting through an opening therein;

a lid removably mountable on the container to close the opening when the container is not in use for holding flowers, the lid including spaced, opposed recesses on its underside;

a body of stalk-supporting material removably positioned within the container for receiving and supporting the ends of the flower stalks, with the blossoms of the flowers positioned outside the container; and an elongated, flexible retainer having a generally U-shaped portion with first and second legs that can be selectively flexed within a common plane to engage and be retained by the lid recesses, and further having first and second integral extension portions that project outwardly from the ends of the respective first and second legs, the extension portions being sufficiently long to extend through the container opening to engage and be supported by the body of stalk-supporting material, with the U-shaped portion and the lid located outside the container, adjacent to the blossoms of the flowers held in the container.

2. A combination as defined in claim 1, wherein the retainer comprises a single strip of wire formed into the prescribed shape.

3. A combination as defined in claim 1, wherein:

the extension portions of the retainer are substantially straight and perpendicular to the plane of the two legs.

4. A combination as defined in claim 1, wherein:

the lid recesses are defined by an inwardly-projecting lip; and the U-shaped portion of the retainer has a shape that conforms generally with the shape of the lip.

5. A combination as defined in claim 1, wherein:

the lid recesses are defined by an outwardly-projecting lip; and the U-shaped portion of the retainer has a shape that conforms generally with the shape of the lip.

6. A disposable assemblage for use in combination with a container and a mating lid, the container having an opening that can be selectively covered by the lid or used to receive the stalks of a flower arrangement and the lid having two spaced, opposed recesses on its underside, the assemblage comprising:

a body of stalk-supporting material removably positioned within the container, for receiving and supporting the ends of the flower stalks;

and an elongated, flexible retainer having a generally U-shaped portion with first and second legs that can be selectively fixed within a common plane to engage and be retained by the lid recesses, and further having first and second integral extension portions that project outwardly from the ends of the respective first and second legs, the extension portions being sufficiently long to extend through the container opening, to engage and be supported by the body of stalk-supporting material, with the U-shaped portion and the lid located outside the container, adjacent to the blossoms of the flowers held in the container.

7. A disposable assemblage as defined in claim 6, wherein the retainer comprises a single strip of wire formed into the prescribed shape.

8. A combination as defined in claim 6, wherein:

the extension portions of the retainer are substantially straight and perpendicular to the plane of the two legs.

9. A disposable assemblage as defined in claim 6, wherein:

the lid recesses are defined by an inwardly-projecting lip; and the U-shaped portion of the retainer has a shape that conforms generally with the shape of the lip.

10. A disposable assemblage as defined in claim 6, wherein:

the lid recesses are defined by an outwardly-projecting lip; and the U-shaped portion of the retainer has a shape that conforms generally with the shape of the lip.

* * * * *